US005162063A

United States Patent [19]

Shinoda et al.

[11] Patent Number: 5,162,063

[45] Date of Patent: Nov. 10, 1992

[54] MAGNETICALLY ANISOTROPIC R-T-B MAGNET

[75] Inventors: Makoto Shinoda; Katsunori Iwasaki, both of Kumagaya; Shigeho Tanigawa, Kounosu; Masaaki Tokunaga, Fukaya, all of Japan

[73] Assignee: Hitachi Metals Ltd., Tokyo, Japan

[21] Appl. No.: 612,379

[22] Filed: Nov. 14, 1990

[30] Foreign Application Priority Data

Nov. 14, 1989 [JP] Japan ..... 1-295331
Apr. 24, 1990 [JP] Japan ..... 2-108312

[51] Int. Cl.[5] ..... H01F 1/02

[52] U.S. Cl. ..... 148/101; 148/104; 419/11; 419/34; 419/35

[58] Field of Search ..... 148/101, 104; 419/11, 419/34, 35

[56] References Cited

U.S. PATENT DOCUMENTS 4,780,226 10/1988 Sheets et al. ..... 252/28
4,952,251 8/1990 Iwasaki et al. ..... 148/101
4,978,398 12/1990 Iwasaki et al. ..... 148/101

FOREIGN PATENT DOCUMENTS 0133758 3/1985 European Pat. Off. .
61-266056 11/1986 Japan .
1-251703 10/1989 Japan .

*Primary Examiner*—John P. Sheehan
*Attorney, Agent, or Firm*—Sughrue, Mion, Zinn, Macpeak & Seas

[57] ABSTRACT

A magnetically anisotropic R-T-B magnet having crystal grains having aspect ratios of 2 or more and showing a substantially uniform maximum energy product distribution is produced by (a) rapidly quenching an alloy melt; (b) finely pulverizing the rapidly quenched alloy to provide magnetic powder; (c) mixing the magnetic powder with a carbon-containing additive; (d) coating the resulting mixture with a protective layer of a first lubricant such as BN substantially unreactive with the alloy components; (e) compressing it; (f) further coating the resulting compressed body with a second lubricant such as graphite or graphite+glass; and (g) further compressing it.

5 Claims, 3 Drawing Sheets

MAGNETICALLY ANISOTROPIC R-T-B MAGNET

BACKGROUND OF THE INVENTION

The present invention relates to a magnetically anisotropic R-T-B magnet based on a transition metal (T), a rare earth element (R) including Y and boron (B), and more particularly to a magnetically anisotropic magnet showing a maximum energy product distribution substantially uniform between its center portion and its circumferential portion so that it can be suitably used for voice coil motors, magnetrons, linear motors, MRI, etc.

With respect to permanent magnets used in magnetic circuits of voice coil motors, magnetrons, linear motors, MRI, etc., it is important not only that they have large absolute values of maximum energy product $(BH)_{max}$, but also that the maximum energy product is distributed substantially uniformly between the center portion and the circumferential portion. Particularly recently, permanent magnets having such properties are increasingly needed.

Since permanent magnets based on rare earth elements (R), transition metals (T) and boron (B) (hereinafter referred to as "R-T-B magnets") are inexpensive and show high magnetic properties, they have been attracting much attention as those satisfying the above-mentioned requirements (Japanese Patent Laid-Open No. 61-266056).

The R-T-B magnets are classified into sintered magnets and rapidly quenched magnets. Among them, permanent magnets produced by rapidly quenching alloy melts to form thin ribbons or flakes, finely pulverizing them, hot-pressing the pulverized alloys and then subjecting them to high-temperature plastic working to impart magnetic anisotropy thereto (hereinafter referred to as "plastically hot-worked magnets") have been increasingly attracting attention (Japanese Patent Laid-Open No. 60-100402).

Known as such plastically hot-worked magnets are those showing maximum energy product satisfying the relation: $(A-B)\times 100/A \leqq 4$, wherein A represents maximum energy product in a center portion and B represents maximum energy product in a circumferential portion, an average value of the overall maximum energy product being 20 MGOe or more with little unevenness (Japanese Patent Laid-Open No. 1-251703).

However, as is clear from the above relation, these plastically hot-worked magnets require $A \geqq B$, and their overall maximum energy products are 22.9–25.2 MGOe (See Examples), which are insufficient to constitute high-performance magnetic circuits. The reason why $A \geqq B$ should be met is considered that the center portions of the magnets are less plastically flowable than the circumferential portions due to friction between the magnets and die surfaces in the process of plastic working. In any case, such restrictions are undesirable to meet the demands in the market place.

Incidentally, although Japanese Patent Laid-Open No. 1-251703 is silent, the uneven deformation of the magnets causes a bulge phenomenon which leads to large cracks in the circumferential portions of the resulting magnets. This is a serious problem in the case of obtaining high-performance magnets. Particularly, in the case of voice coil motors used in outside memory apparatuses of computers, dusting due to cracks causes serious troubles.

OBJECT AND SUMMARY OF THE INVENTION

Accordingly, an object of the present invention is to provide a plastically hot-worked magnet having a uniform maximum energy product distribution and suffering from no cracking.

As a result of intense research in view of the above object, the inventors have found that the above object can be achieved by an optimum combination of a carbon-containing additive having remarkable effects of increasing magnetic properties by reaction with magnetic powder, an optimum lubricant substantially unreactive with the plastically hot-worked magnet, which is an active product, and an optimum high-temperature plastic working process, particularly a multi-step plastic working process using suitable lubricants.

Thus, the magnetically anisotropic magnet according to the present invention is made of an R-T-B alloy based on a transition metal (T), a rare earth element (R) including Y and boron (B) and having crystal grains having aspect ratios of 2 or more, the magnet having a maximum energy product distribution which is substantially uniform between a center portion and a circumferential portion thereof.

The first method of producing a magnetically anisotropic magnet according to the present invention comprises the steps of:

(a) rapidly quenching a melt consisting essentially of a transition metal, a rare earth element including Y and boron;
(b) finely pulverizing the resulting rapidly quenched alloy to provide magnetic powder;
(c) mixing the magnetic powder with a carbon-containing additive;
(d) compressing the resulting mixture;
(e) placing the resulting compressed body in a hot-working die with a lubricant applied to a surface of the compressed body and/or a surface of the die; and
(f) subjecting the compressed body to a high-temperature plastic working.

The second method of producing a magnetically anisotropic magnet according to the present invention comprises the steps of:

(a) rapidly quenching a melt consisting essentially of a transition metal, a rare earth element including Y and boron;
(b) finely pulverizing the resulting rapidly quenched alloy to provide magnetic powder;
(c) mixing the magnetic powder with a carbon-containing additive;
(d) coating the resulting mixture with a protective layer of a first lubricant substantially unreactive with the alloy components;
(e) compressing it;
(f) further coating the resulting compressed body with a second lubricant; and
(g) further compressing the compressed body.

BRIEF DESCRIPTION OF THE DRAWINGS

FIG. 3(*b*) is a graph showing the relation between a tensile stress and an upset ratio in the first and second steps in Example 4.

DETAILED DESCRIPTION OF THE INVENTION

Figure 1:
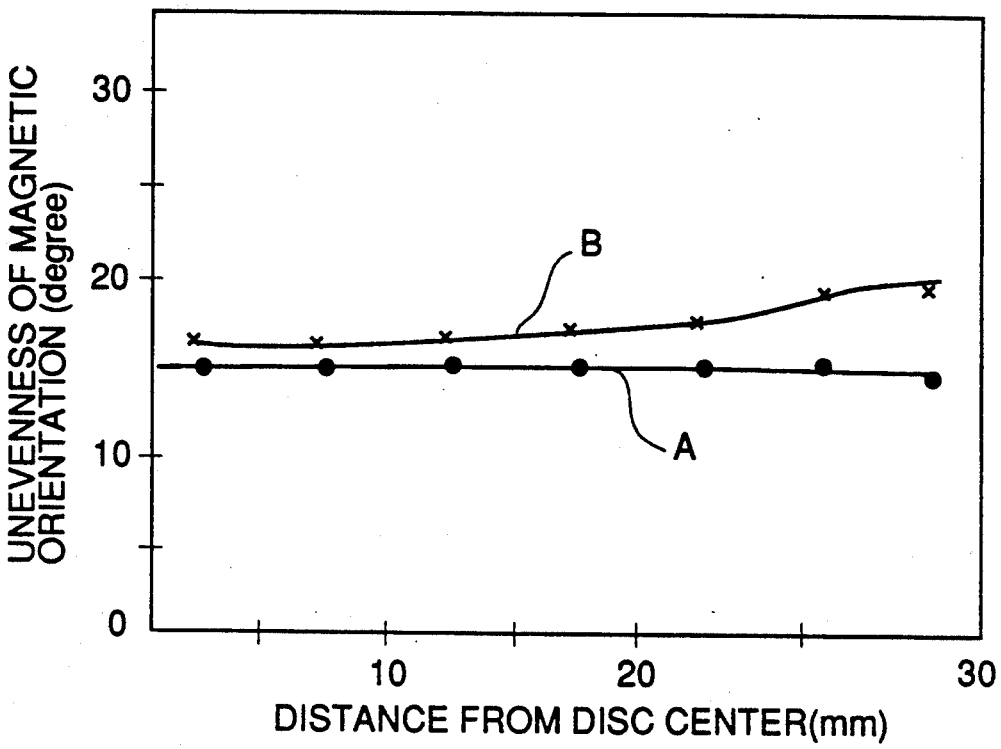
FIG. 1 is a graph showing the relation between the unevenness of magnetic orientation and the distance from a disc center of the sample in the plastically hot-worked magnet of the present invention (Example 1) and in that of Comparative Example 1.

The first feature of the present invention is that the crystal grains of the magnetically anisotropic magnet have aspect ratios of 2 or more. The term "aspect ratio" used herein means a ratio c/a, wherein "c" represents an average diameter of the crystal grains in a direction perpendicular to their C-axes, and "a" represents an average diameter of the crystal grains in their C-axis directions. When the aspect ratio is 2 or more, the magnetically anisotropic magnet shows improved evenness of magnetic orientation and thus residual magnetic flux densities of 12 kG or more. Incidentally, the average diameter is determined by a so-called "intersection method," in which arbitrary linear lines are drawn on an electron microphotograph, the number of crystal grains crossing each linear line is counted and the length of each linear line is divided by the number of crystal grains crossing it to determine the average diameter. In the present invention, linear lines crossing 30 or more crystal grains are used to determine the average diameter.

The present invention also provides a method of producing a magnetically anisotropic magnet comprising the steps of:

(a) rapidly quenching a melt consisting essentially of a transition metal, a rare earth element including Y a and boron;
(b) finely pulverizing the resulting rapidly quenched alloy to provide magnetic powder;
(c) mixing the magnetic powder with a carbon-containing additive;
(d) compressing the resulting mixture;
(e) placing the resulting compressed body in a hot-working die with a lubricant applied to a surface of the compressed body and/or a surface of the die; and
(f) subjecting the compressed body to a high-temperature plastic working.

The carbon-containing additive used in the present invention may be organic or inorganic compounds, and preferably bivalent lower alcohols such as diethylene glycol. Graphite may also be used as the carbon-containing additive. In this case, a combination of graphite as the carbon-containing additive and glass is preferable to prevent the excess growth of the crystal grains.

The plastic working may be conducted by one or more steps. Two or more-step plastic working is preferable to achieve the object of the present invention, but one-step plastic working may be conducted depending upon the shapes and the sizes of the products.

In the high-temperature plastic working, there is a close correlation between plastic flow and magnetic orientation perpendicular to the plastic flow. To improve the magnetic orientation having a close relation to magnetic properties, it is necessary to uniformly cause plastic flow in the entire body of the magnet product. In addition, to achieve high maximum energy product, a high working ratio (percentage of the reduction of a height to a height before upsetting) is necessary. However, since intensive working is likely to cause cracking in the circumferential portion of the magnet, it is necessary to reduce friction between the magnet product and a die.

In the plastic working, the formation of a protective layer of a lubricant substantially unreactive with alloy components and further the lamination of a second lubricant thereon are effective to achieve a high working ratio while preventing cracking and an uneven distribution of maximum energy product in the plastically hot-worked magnet.

Thus, there is provided the second method of producing a magnetically anisotropic magnet comprising the steps of:

(a) rapidly quenching a melt consisting essentially of a transition metal, a rare earth element including Y and boron;
(b) finely pulverizing the resulting rapidly quenched alloy to provide magnetic powder;
(c) mixing the magnetic powder with a carbon-containing additive;
(d) coating the resulting mixture with a protective layer of a first lubricant substantially unreactive with the alloy components;
(e) compressing it;
(f) further coating the resulting compressed body with a second lubricant; and
(g) further compressing the compressed body.

Generally, cracks are generated in the upsetting process, when maximum stress applied exceeds the strength of the product. The maximum stress increases at a certain working ratio as a kinetic friction coefficient between the work and the die increases.

In this sense, there are two means for suppressing the generation of cracks: One is to increase the strength of the work, and the other is to decrease the friction coefficient between the work and the die.

With respect to the strength of the work, it can be increased by adding a carbon-containing additive to the magnet powder. The increase of the strength is achieved presumably because the additive reacts with magnetic powder to prevent the generation of coarser crystal grains, thereby improving the fluidity of the work and improving the mechanical strength of the grain boundaries. Incidentally, with respect to the generation mechanism of coarser crystal grains, it is described in Japanese Patent Application No. 1-292889 filed Nov. 10, 1989. The volume percentage of crystal grains having diameters exceeding 0.7 μm should be less than 20%.

Incidentally, to meet the above requirements, the permanent magnet preferably has a composition of 11–18 atomic % of Y, 4–11 atomic % B and the balance of T.

When the amount of R is smaller than 11 atomic %, plastic deformation is difficult because as R-rich liquid phase is not sufficiently formed, and a sufficient coercive force is not obtained. On the other hand, when it exceeds 18 atomic %, the percentage of a main phase in the resulting magnet decreases, making it likely that coarse crystal grains exceeding 0.7 μm are excessively formed, which leads to the deterioration of residual magnetic flux density. The preferred amount of R is 13–15 atomic %.

When the amount of B is less than 4 atomic %, the main phase ($Nd_2Fe_{14}B$) is not fully formed, resulting in low residual magnetic flux density and coercive force.

On the other hand, when the amount of B exceeds 11 atomic %, phases undesirable to magnetic properties are generated, resulting in low residual magnetic flux density. The preferred amount of B is 5–7 atomic %.

T may be constituted by Fe which may be partially substituted by Co. When Co is contained, the upper limit of the Co content is 30 atomic % based on the weight of the magnet. Also, when Co exceeds 20 atomic %, plastic deformation becomes difficult. Accordingly, the amount of Co is desirably 20 atomic % or less.

The permanent magnet may further contain at least one of Ga, Zn, Si, Al, Nb, Zr, Hf, Mo, P, C and Cu in an amount of not exceeding 3 atomic %.

With respect to the reduction of the friction coefficient, it is general to use a proper lubricant, and a more lubricant is needed as the surface area of the work increases in the process of upsetting. In addition, there is a problem of reaction between the alloy components and lubricants. Lubricants usually used for plastic working are reactive with magnets which are active at a high temperature, thereby causing their seizing with a die or a plunger.

In view of this fact, two-step working such as two-step die-upsetting is preferable, in which a lubricant is applied to the surface of the work in each step, thereby reducing the friction coefficient between the work and the die. This in turn leads to the reduction of a tensile stress generated in the work due to a bulging phenomenon caused by the friction between the work and the die.

In the two-step working, a protective layer of a first lubricant substantially unreactive with the alloy components is formed on the surface of the work before or in the first step of compressing or upsetting. In the second step, a second lubricant having an excellent lubricating function is applied to the surface of the work. For instance, boron nitride (BN) substantially unreactive with the alloy is used in the first step to produce a BN protective layer on the work, and then a second lubricant having good lubrication such as a combination of graphite or graphite+glass is used in the subsequent upsetting step.

In such a multi-step working according to the present invention, the working temperature is preferably within the range of 630°–830° C. When it is lower than 630° C., Nd-rich phases (liquid phases) necessary for plastic deformation are less likely to generate, increasing the deformation resistance of the work, which leads to a large number of cracks. On the other hand, when the working temperature exceeds 830° C., the crystal grains become too coarse, deteriorating the workability.

In sum, the carbon-containing additive may be any compound containing carbon atoms such as graphite, alcohols, etc. The first lubricant should be a compound substantially unreactive with the alloy components, and preferably it is BN, etc. The second lubricant should have good lubricating function, and it may be graphite or graphite+glass or any other lubricants. In a preferred combination, the carbon-containing additive is bivalent lower alcohol, the first lubricant constituting the protective layer is BN, and the second lubricant is graphite or graphite+glass.

The present invention will be explained in further detail by way of the following Examples.

EXAMPLES 1, COMPARATIVE EXAMPLES 1, 2

An alloy having a composition of $Nd(Fe_{0.82}Co_{0.1}B_{0.07}Ga_{0.01})_{5.4}$ was prepared by an arc melting method. This alloy was ejected onto a single roll rotating at a peripheral speed of 30 m/sec in an Ar atmosphere to produce thin flakes having irregular shapes with thicknesses of about 30 μm. As a result of X-ray diffraction analysis, it was found that the flakes had amorphous phases and crystalline phases constituted by innumerable fine crystal grains having diameters of about 0.3 μm or less.

The thin flakes were pulverized to magnetic powder of 500 μm or less and mixed with diethylene glycol (bivalent lower alcohol) and compressed in a die under a pressure of 3 ton/cm$^2$ without applying a magnetic field to produce a compressed body having a density of 5.7 g/cc and a diameter of 28 mm and a height of 47 mm.

The resulting compressed body was sprayed with a boron nitride (BN) suspension in alcohol, and after drying, hot-pressed at 690° C. under 1 ton/cm$^2$ to produce a compressed body of 30 mm in diameter and 30 mm in height having a density of 7.4 g/cc. In this case, no cracks were generated in the periphery of the compressed body.

Next, this high-density compacted product was further die-upset to 690° C. at an upset ratio of 45%. It was then sprayed with a BN suspension and then die-upset to an upset ratio of 60%.

For comparison, one-step die-upsetting at an upset ratio of 60% was conducted without supplementing BN (Comparative Example 1). Further, without adding diethylene glycol to the magnetic powder, two-step die-upsetting was conducted (Comparative Example 2).

Magnetic properties and aspect ratios of the resulting plastically hot-worked magnets are shown in Table 1. The magnet of the present invention showed no cracking, while those of Comparative Examples 1 and 2 suffered from large cracks.

TABLE 1

| Sample No. | $(BH)_{max}$ (MGOe) | Br (kG) | Aspect Ratio |
|---|---|---|---|
| Example 1 | 36.5 | 12.1 | 2.5 |
| Comparative Example 1 | 32.2 | 11.6 | 1.7 |
| Comparative Example 2 | 30.7 | 11.2 | 1.5 |

It is clear from Table 1 that by two-step die-upsetting and by supplementing a lubricant, cracking in the peripheral portion can be prevented.

With respect to the compressed bodies in Example 1 and Comparative Examples 1 and 2, tensile strength was measured at 700° C. The results are shown in Table 2.

TABLE 2

| Sample No. | Tensile Strength (kg/cm$^2$) |
|---|---|
| Example 1 | 0.18 |
| Comparative Example 1 | 0.14 |
| Comparative Example 2 | 0.12 |

It is clear from Table 2 that the addition of diethylene glycol is effective to increase the mechanical strength of the work, thereby preventing the cracking in the die-upsetting process.

With respect to the sample obtained in Example 1, the distribution of magnetic orientation on the side of an upper plunger was examined by X-ray diffraction analysis. The results are shown in FIG. 1. Incidentally, in FIG. 1, the distribution of magnetic orientation is normalized with respect to an angle relative to the C-axis of each crystal grain. FIG. 1 shows the deviation of the C-axes of the crystal grains from the direction of pressure applied in the process of plastic working, and the deviation is expressed as standard deviation assuming that X-ray diffraction intensity is in a Gaussian distribution.

As is clear from FIG. 1, the permanent magnet of the present invention (Example 1: A) shows a uniform magnetic orientation on the surface. On the other hand, the permanent magnet of Comparative Example 1(B) shows a large unevenness of magnetic orientation in the circumferential portion. This means that in Comparative Example 1 the lubricant becomes insufficient during the process of die-upsetting, reducing the plastic flow on the surface of the work.

Figure 2:
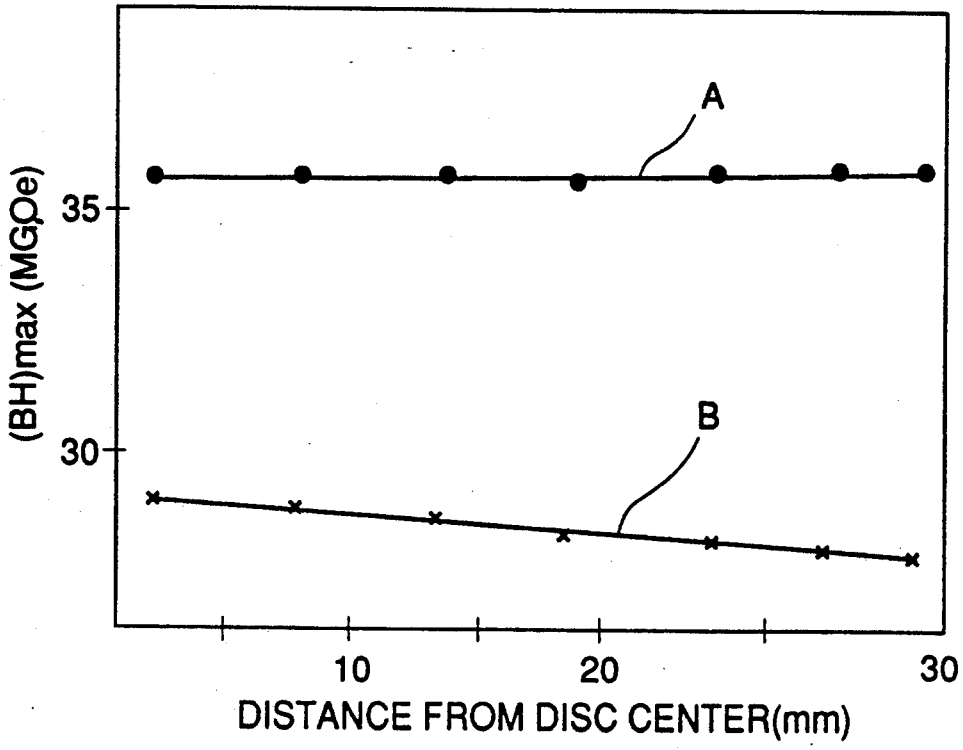
FIG. 2 is a graph showing the relation between the distribution of $(BH)_{max}$ and the distance from a disc center of the sample in the plastically hot-worked magnet of the present invention (Example 1) and in that of Comparative Example 1.

FIG. 2 shows the distribution of $(BH)_{max}$ in Example 1 (A) and Comparative Example 1(B). The permanent magnet of the present invention shows remarkable improvements in $(BH)_{max}$.

EXAMPLE 2, COMPARATIVE EXAMPLE 3

In the same manner as in Example 1, die-upsetting was conducted by two steps: The first step up to 45% of an upset ratio and the second step up to 70% of an upset ratio. Incidentally, in the second die-upsetting step, a lead borosilicate glass (low-melting point glass) was used. The results are shown in Table 3. For comparison, without using BN (without forming a protective layer), the above glass was used as a lubricant from the beginning, and die-upsetting was conducted to an upset ratio of 70% (Comparative Example 3).

TABLE 3

| Sample No. | $(BH)_{max}$ (MGOe) | c/a(1) | Cracking(2) | Reactivity(3) |
|---|---|---|---|---|
| Example 2 | 35.0 | 2.5 | ○ | ○ |
| Comparative Example 3 | 32.7 | 1.8 | Δ | x |

Note
(1)c/a is an aspect ratio.
(2)○: No cracking. Δ: Slight cracking.
(3)○: The permanent magnet was not reactive with the die surface. x: The permanent magnet was reactive with the die surface, hindering the working.

It is clear from Table 3 that the protective layer of BN can prevent the reaction of the permanent magnet with glass.

EXAMPLE 3

In the same manner as in Example 2, various lubricants were used in the second die-upsetting step after the formation of a BN protective layer. The results are shown in Table 4.

TABLE 4

| External Lubricant | $(BH)_{max}$ | Cracking |
|---|---|---|
| Graphite | 35.1 | ○ |
| Glass + Graphite | 35.3 | ○ |
| Molybdenum Disulfide | 34.9 | Δ |
| Copper Powder | 34.6 | Δ |
| Aluminum Powder | 34.5 | Δ |
| Calcium Stearate | 30.5 | x |

Note
○: No cracks.
Δ: No large cracks but slight cracks.
x: Clearly visible cracks.

It is clear from Table 4 that graphite and graphite+glass are effective lubricants for preventing cracking.

EXAMPLE 4

The magnetic powder in Example 1 was mixed with diethylene glycol, and various lubricants were used to provide them with various friction coefficients to the die, and their tensile stresses were measured at various upset ratios.

Figure 3A:
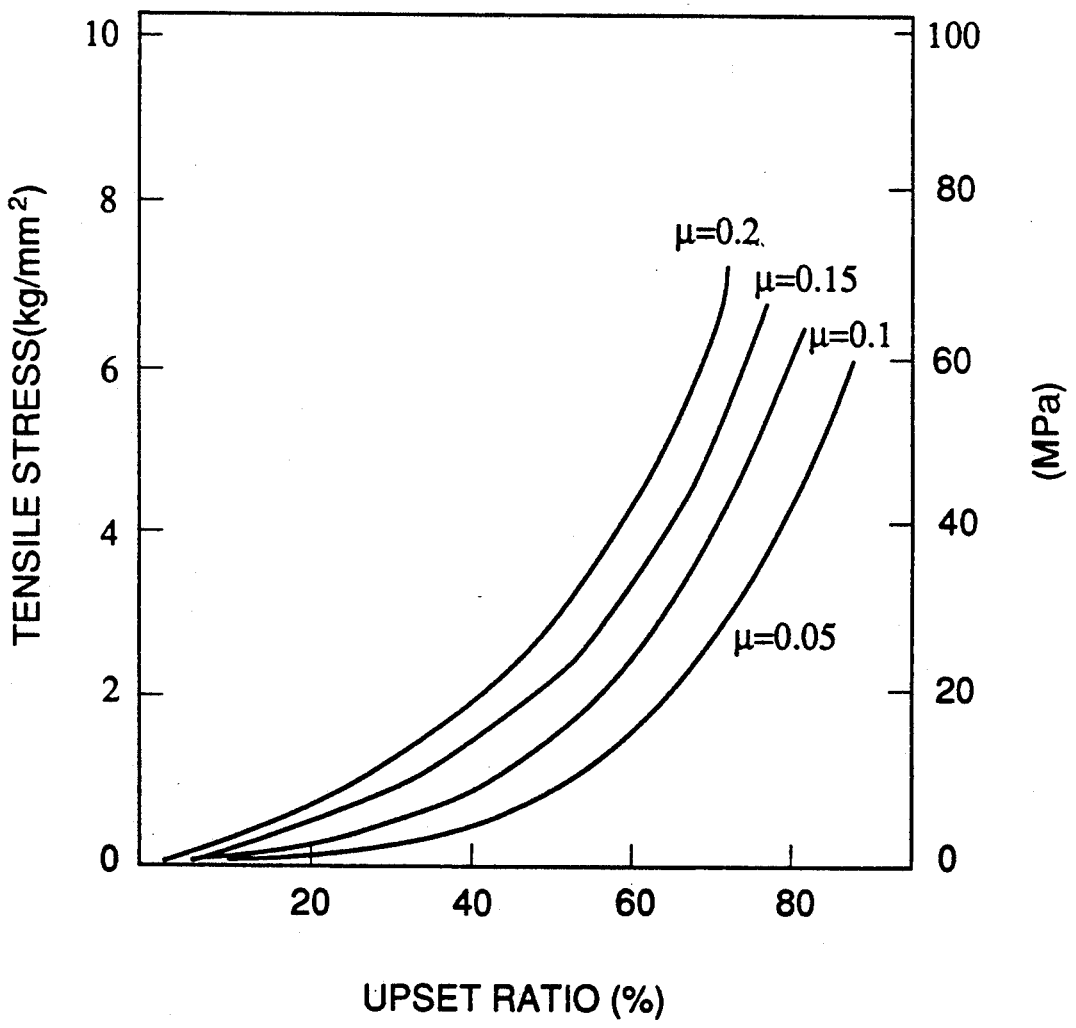
FIG. 3(*a*) is a graph showing the relation between a tensile stress and an upset ratio at various friction coefficients in Example 4.
Figure 3B:
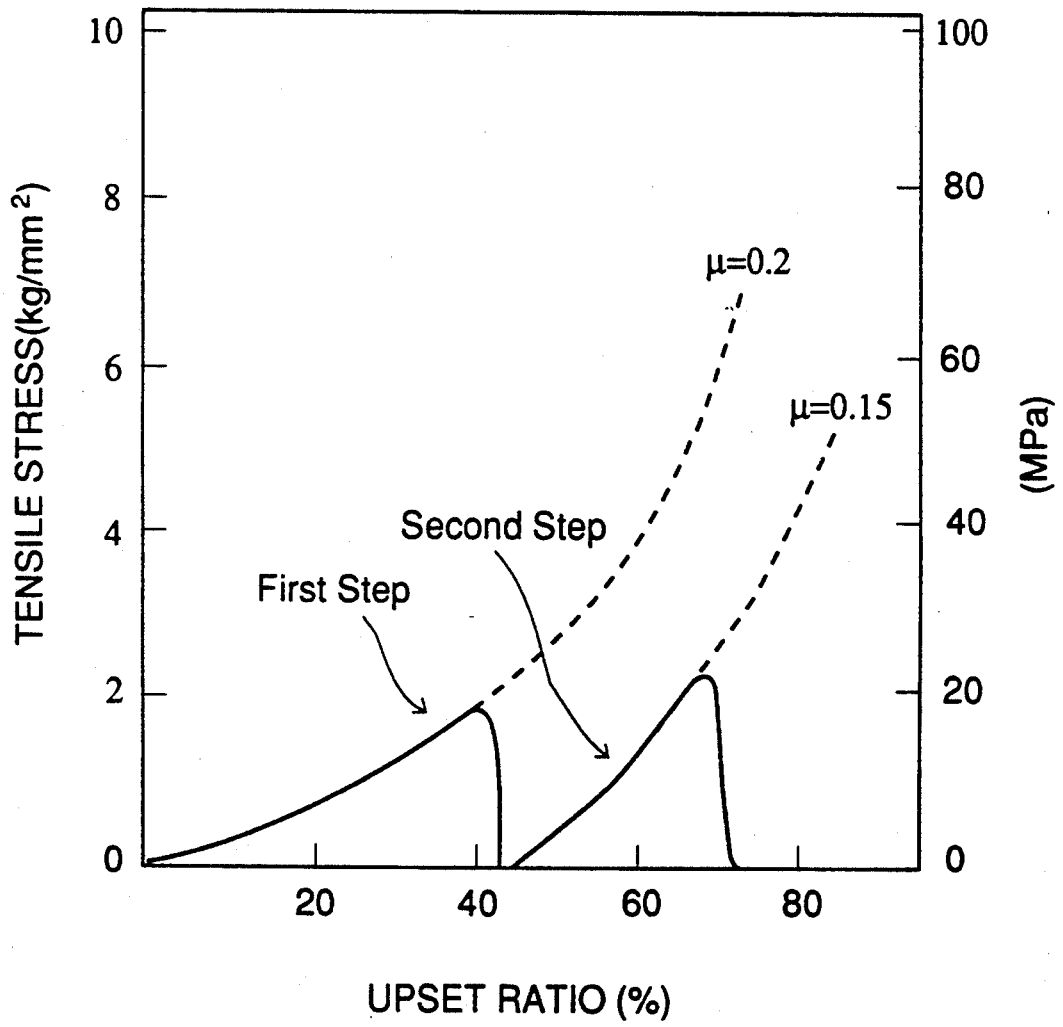

The relation between a working ratio and a tensile stress $\rho_\theta$ generated in the circumferential direction of a sample is shown with a friction coefficient $\mu$ as a parameter in FIG. 3(*a*). In this case, the data at $\mu=0.2$ was obtained by BN, $\mu=0.15$ by graphite+water-soluble disperse medium, and $\mu=0.1$ by glass. The data at $\mu=0.05$ was calculated by a finite element method. The speed of a cross head was 0.25 mm/sec. When $\rho_\theta$ exceeds the strength $\rho_B$ of the sample, cracks are generated in the circumferential portion of the sample, limiting the upset ratio without cracking. In this Example, the first die upsetting step was conducted up to an upset ratio of 40% ($\mu=0.2$), and the second die-upsetting step was conducted at $\mu=0.15$. The relation between a tensile stress and an upset ratio is shown in FIG. 3(*b*). By this two-step die-upsetting process, an accumulated upset ratio of up to 70% can be achieved without cracking in the circumferential portion of the sample.

It is considered that the reduction of the friction coefficient $\mu$ in the second die-upsetting step is achieved due to the function of the second lubricant of graphite or graphite+glass in the second die-upsetting step, because an oxide layer formed in the first step and a BN coating layer serve as protective layers.

As described above in detail, by the method of the present invention, magnetically anisotropic magnets showing substantially uniform distributions of maximum energy products between center portions and circumferential portions can be provided, which are suitable for magnetic circuits increasingly required in the recent market place.

What is claimed is:

1. A method of producing a magnetically anisotropic magnet comprising the steps of:
   (a) rapidly quenching a melt consisting essentially of a transition metal, a rare earth element including Y and boron;
   (b) finely pulverizing the resulting rapidly quenched alloy to provide magnetic powder;
   (c) mixing said magnetic powder with a carbon-containing additive;
   (d) compressing the resulting mixture;
   (e) placing the resulting compressed body in a hot-working die with a lubricant applied to a surface of said compressed body and/or a surface of said die; and
   (f) subjecting the compressed body to a high-temperature plastic working.

2. The method according to claim 1, wherein said plastic working is die upsetting conducted by 2 or more steps.

3. A method of producing a magnetically anisotropic magnet comprising the steps of:
   (a) rapidly quenching a melt consisting essentially of a transition metal, a rare earth element including Y and boron;
   (b) finely pulverizing the resulting rapidly quenched alloy to provide magnetic powder;

(c) mixing said magnetic powder with a carbon-containing additive;
(d) coating the resulting mixture with a protective layer of a first lubricant substantially unreactive with said alloy components;
(e) compressing it;
(f) further coating the resulting compressed body with a second lubricant; and
(g) further compressing the compressed body.

4. The method of producing a magnetically anisotropic magnet according to claim 3, wherein said carbon-containing additive is a bivalent lower alcohol, said first lubricant is boron nitride, and said second lubricant is graphite or graphite+glass.

5. The method of producing a magnetically anisotropic magnet according to claim 4, wherein said bivalent lower alcohol is diethylene glycol.

* * * * *